US006518533B1

(12) United States Patent
Haghiri

(10) Patent No.: US 6,518,533 B1
(45) Date of Patent: Feb. 11, 2003

(54) HIGH STRENGTH STEEL TUBING

(75) Inventor: David S. Haghiri, Ashley, OH (US)

(73) Assignee: LTV Steel Company, Inc., Cleveland, OH (US)

( * ) Notice: Subject to any disclaimer, the term of this patent is extended or adjusted under 35 U.S.C. 154(b) by 0 days.

(21) Appl. No.: 09/998,852

(22) Filed: Nov. 1, 2001

(51) Int. Cl.[7] ..... B23K 11/00; B21D 39/00

(52) U.S. Cl. ..... 219/61; 219/117.1; 228/144; 228/173.6

(58) Field of Search ..... 219/59.1, 60 R, 219/60.2, 61, 91.2, 91.23, 107, 117.1; 228/129, 144, 145, 173.6, 17.5, 17.7

(56) References Cited

U.S. PATENT DOCUMENTS

| | | | | |
|---|---|---|---|---|
| 3,857,740 | A | * | 12/1974 | Gondo et al. |
| 4,410,369 | A | * | 10/1983 | Waid et al. |
| 5,213,633 | A | * | 5/1993 | Hada et al. |
| 5,403,986 | A | * | 4/1995 | Goleby |
| 5,772,956 | A | * | 6/1998 | Hasegawa et al. |

FOREIGN PATENT DOCUMENTS

| | | | | |
|---|---|---|---|---|
| EP | 0494448 | A1 | * | 7/1992 |
| JP | 403082738 | A | * | 4/1991 |
| JP | 03188218 | A | * | 8/1991 |
| JP | 403285017 | A | * | 12/1991 |
| JP | 404263019 | A | * | 9/1992 |
| JP | 404289122 | A | * | 10/1992 |
| JP | 04365815 | A | * | 12/1992 |
| JP | 405117809 | A | * | 5/1993 |
| JP | 409053119 | A | * | 2/1997 |
| JP | 411106825 | A | * | 4/1999 |
| JP | 411114624 | A | * | 4/1999 |

* cited by examiner

*Primary Examiner*—Tom Dunn
*Assistant Examiner*—Kiley Stoner
(74) *Attorney, Agent, or Firm*—Watts, Hoffmann, Fisher & Heinke, Co., L.P.A.

(57) ABSTRACT

High strength steel tube is made from a full hard, cold rolled steel sheet having a chemistry compliant to S.A.E. J 403 grade 1026. The high strength of the tube is a result of specified thermal-mechanical processing of hot rolled sheet followed by controlled percent cold rolled reduction, and does not require post-welding thermal heat treatment and/or cold drawing processing.

3 Claims, No Drawings

HIGH STRENGTH STEEL TUBING

BACKGROUND OF THE INVENTION

This invention relates generally to steel tubing, and, more specifically, to a new process of making steel tubing utilizing full hard, cold rolled sheet having a chemistry compliant with industry standard S.A.E. J 403 grade 1026 welded by the electric resistance welding method.

The tubing made in accordance with the invention is intended to replace current drawn-over-mandrel (DOM) tube used in the manufacture of products requiring high torsional strength, such as propeller shafts and the like. DOM tube is made by drawing an electric resistance welded tube over a mandrel to stretch the tube and give it a specific ID. The tube typically requires thermal and/or cold drawing in order to achieve the desired strength levels. The DOM process is relatively expensive and requires considerable labor. See U.S. Pat. No. 5,411,198.

SUMMARY OF THE INVENTION

The process of the present invention comprises the steps of hot rolling steel sheet, coiling the sheet at a temperature in a range of from about 1000–1200° F., subjecting the sheet to cold reduction in the range of about 15–30%, forming the sheet into a tube, and joining the edges of the tube by electric resistance welding. In the preferred process, the steel has a chemistry compliant with industry standard S.A.E. J 403 grade 1026 comprising 0.22–0.28 C, 0.60–0.90 Mn, 0.035 maximum S, and 0.035 maximum P.

Tubing made in accordance with the present invention can be made at a lower cost than DOM tubing. It does not require any post-welding thermal treatment processing and does not undergo any cold drawing processing. The high strength levels that are achieved are a result of the specified thermal-mechanical processing of the hot rolled sheet, i.e. coiling at the specified temperatures, and the controlled amount of cold reduction of the sheet. Tubing made in the manner described have yield strengths at or above 75,000 psi, as measured in tension in a longitudinal orientation, which is necessary to meet the torque capacity required for propeller shaft applications and the like.

An added advantage is that the new process is versatile in the tubing sizes that can be made. More specifically, tube can be produced to any one of (1) an outside diameter and wall thickness requirement, (2) an inside diameter and wall thickness requirement, or (3) an outside diameter and inside diameter requirement. Other features and advantages of the invention will be apparent from the following detailed description.

DESCRIPTION OF PREFERRED EMBODIMENT

The first step of the new process entails producing hot rolled sheet having a chemistry compliant with S.A.E. J 403 grade 1026 and comprising 0.22–0.28 C, 0.60–0.90 Mn, 0.035 maximum P, and 0.035 maximum sulfur. The foregoing chemistry is typical of 1026 steel. It is contemplated, however, that other steel grades can be used.

In the second step of the process, the hot rolled sheet is coiled at a temperature ranging from about 1000° to about 1200° F. The coiling temperature and the subsequent cold rolled reduction are necessary to achieve the desired strengths of 75,000 psi or higher.

In the third step of the process, the hot rolled sheet is subjected to cold rolled reduction in the range of 15% to 30% to impart high strength as a full hard cold rolled steel.

The cold rolled sheet is then bent into tubular form and the edges joined by electric resistance welding, all according to known techniques.

It is to be understood that, within the scope of the appended claims, the invention can be practiced otherwise than as specifically disclosed.

What is claimed is:

1. A method of making steel tubing capable of withstanding torsional loading comprising the steps of hot rolling steel sheet containing 0.22–0.28 C, 0.60–0.90 Mn, 0.035 maximum S and 0.035 maximum P, processing the sheet by coiling and cold reduction under conditions sufficient to obtain a 75,000 psi minimum yield strength in tension as tested in the longitudinal direction, bending the sheet into tubular form, and completing the tube by electric resistance welding.

2. The method as claimed in claim 1 wherein the sheet is coiled at a temperature of about 1000–1200° F.

3. The method as claimed in claim 1 or claim 2 wherein the sheet is cold reduced by an amount of about 15–30%.

* * * * *